US005478365A

United States Patent [19]

Nikanjam et al.

[11] Patent Number: 5,478,365

[45] Date of Patent: Dec. 26, 1995

[54] HEAVY HYDROCARBON EMULSIONS AND STABLE PETROLEUM COKE SLURRIES THEREWITH

[75] Inventors: Manuch Nikanjam, Richmond, Calif.; Charles T. Buse, Basel, Switzerland; David A. Kohler, Oakland, Calif.; John W. Muzatko, Pinole, Calif.

[73] Assignee: Chevron U.S.A. Inc., San Francisco, Calif.

[21] Appl. No.: 656,344

[22] Filed: Feb. 15, 1991

Related U.S. Application Data

[63] Continuation of Ser. No. 331,483, Mar. 31, 1989, abandoned, which is a continuation-in-part of Ser. No. 930,610, Nov. 13, 1986, abandoned, which is a continuation-in-part of Ser. No. 282,093, Dec. 9, 1988, abandoned.

[51] Int. Cl.[6] ..... C10L 1/32

[52] U.S. Cl. ..... 44/280; 44/301; 44/313; 44/380

[58] Field of Search ..... 44/280, 380, 422, 44/301, 313; 208/13–15, 22, 39, 45; 252/311.5

[56] References Cited

U.S. PATENT DOCUMENTS

| | | | |
|---|---|---|---|
| 3,321,394 | 5/1967 | Mills | 208/45 |
| 4,108,681 | 8/1978 | Lawson et al. | 208/45 |
| 4,139,451 | 2/1979 | Pavilcius | 208/22 |
| 4,239,616 | 12/1980 | Gearhart | 208/45 |
| 4,358,293 | 11/1982 | Mark | 44/51 |
| 4,403,998 | 9/1983 | Schulz et al. | 44/51 |
| 4,537,600 | 8/1985 | Tajima et al. | 44/61 |
| 4,539,012 | 9/1985 | Ohzeki et al. | 44/51 |
| 4,565,546 | 1/1986 | Ohzeki et al. | 44/61 |
| 4,572,781 | 2/1986 | Krasuk et al. | 208/45 |
| 4,579,563 | 4/1986 | Burnside et al. | 44/51 |
| 4,592,831 | 6/1986 | Rhoe et al. | 208/45 |
| 4,610,695 | 9/1986 | Crispin et al. | 44/61 |

FOREIGN PATENT DOCUMENTS

| | | | |
|---|---|---|---|
| 1179132 | 11/1984 | Canada | 44/72 |

*Primary Examiner*—Margaret Medley
*Attorney, Agent, or Firm*—J. J. DeYoung; V. J. Cavalieri

[57] ABSTRACT

Disclosed is a combustible heavy hydrocarbon-in-water emulsion comprising: a. a nitrogen base neutralized phosphate-ester emulsifier in about 0.2 to about 1.0 wt. % amount; b. a water-soluble emulsion stabilizer comprising a high molecular weight water-soluble thickener in about 0.02 to about 0.2 wt. % amount; c. water in about 25 to 50 wt. % amount; and d. a high-softening point hydrocarbon material in an amount to make 100 wt. % emulsion wherein said hydrocarbon material is present in said emulsion in the form of substantially spherical particles having a median diameter in the range of 1 to 30 microns. Also disclosed and claimed is a combustible slurry fuel made from said emulsion which contains carbonaceous solids, particularly petroleum coke. The process for making the emulsion and slurry fuel is also disclosed and claimed.

19 Claims, 3 Drawing Sheets

Emulsification

Grinding

HEAVY HYDROCARBON EMULSIONS AND STABLE PETROLEUM COKE SLURRIES THEREWITH

CROSS REFERENCE TO RELATED APPLICATIONS

This application is a continuation of Ser. No. 331,483, filed on Mar. 31, 1989, now abandoned, which is a continuation-in-part of Ser. No. 930,610, filed Nov. 13, 1986, now abandoned, which is a continuation-in-part of Ser. No. 282,093, filed on Dec. 09, 1988, now abandoned, the entire disclosures of which are incorporated herein by reference.

BACKGROUND OF THE INVENTION

The bottoms from a solvent deasphalting process, hereinafter referred to as "SDA tar", is a high-softening point hydrocarbon of limited utility. Although it does burn, it is difficult to deliver to the furnace in a manageable form. Currently, SDA tar is mixed with petroleum fractions, typically in approximately equal volumes, to form mixtures which are then used as fuel. However, to burn SDA tar by this process, requires the use of higher value materials, such as cracked gas oil, to carry the SDA tar to the burner tip.

A common problem with many fuels is the tendency for low melting slag formation on the heat exchange surfaces of the furnace. Slag is formed as a result of impurities in the fuel. Formation of slag renders many fuels unacceptable for continued usage because excessive slag formation causes severe equipment corrosion and the loss of heating value through reduced heat exchange.

The vast majority of combustible emulsions known in the art are water-in-oil emulsions. In these emulsions oil is the continuous phase and water the discontinuous phase. Usually, the water content is 5–20 wt. %, typically less than 10%. These water-in-oil emulsions have viscosities that are similar to the viscosity of the oil phase. Water-in-oil emulsions made from hydrocarbons with high viscosities require heating to facilitate flow. Hydrocarbons such as bunker fuel oils are sometimes burned as water-in-oil emulsions.

The purpose of the water in these water-in-oil emulsions is to provide secondary atomization of the fuel. Primary atomization is accomplished at the burner nozzle tip. However, with high viscosity fuels, this atomization is insufficient to give good burning characteristics. Secondary atomization, due to the rapid formation of steam from the emulsified water, has been shown to facilitate burning of the hydrocarbon. Typically, these water-in-oil emulsions are formed in-line right before burning, i.e., formed in the same fuel line to the burner.

In contrast, for the hydrocarbon-in-water emulsions of the present invention, water is the continuous phase. The primary function of the water is to reduce the fuel viscosity. It is a fluidizing agent, allowing the emulsion to be handled as a liquid, rather than as a solid. With water as the continuous phase, the viscosity of the fuel is much lower than that of the hydrocarbon alone. Moreover, emulsification of the heavy hydrocarbon phase results in a pre-atomization of the hydrocarbon, which facilitates burning. The net result is a lower flame temperature and lower $NO_x$ emissions.

Hydrocarbon-in-water mixtures are also known in the art wherein heavy hydrocarbons are mechanically ground or fractured at temperatures below the softening point of the heavy hydrocarbon and then mixed with the aide of various chemical additives to produce combustible hydrocarbon-in-water mixtures. The heavy hydrocarbons produced by such processes are composed of particle of irregular shape, displaying the typical conchoidal fracture patterns characteristic of breaking/grinding of a semi-solid glassy material below its softening point.

U.S. Pat. No. 4,537,600 relates to slurries containing water and coarse pitch particles. The pitch is comminuted into particles using a colloid mill operated at conditions of temperature (below 212° F.) and pressure (atmospheric) such that the pitch is contacted with water below the softening point of the pitch. The coarse pitch particles are solidified by contact with water and then further pulverized to form a slurry containing finely pulverized particles.

U.S. Pat. Nos. 4,539,012 and 4,565,546 relate to specific additives for use in pitch-in-water slurries. The slurries are made by combining finely divided pitch in water. These patents contain no teaching of the formation of an emulsion from two liquids whereby a heavy hydrocarbon in water emulsion is made.

U.S. Pat. No. 4,610,695 teaches fuel mixtures containing petroleum residues and pulverized solids such as coal. In examples 1 and 5 the patent specifically teaches the use of a sodium-containing additive (soda) which is detrimental to such fuels in that sodium leads to slag formation.

Petroleum coke is produced at an enormous rate in petroleum refineries. It is a bottoms product of petroleum refining which is now sold for fuel as a solid, or for use as electrical anodes if it has the necessary low sulfur, metals, and volatiles content. If petroleum coke were available as a liquid product, it would make a very attractive fuel because of its high BTU content. Slurries of petroleum coke and/or SDA tar having high solid loadings, (i.e., greater than 50%, preferably greater than 70% solids content by weight) are not usual.

U.S. Pat. No. 4,162,143 teaches water-in-oil emulsions of fuel oil including particulate slurries dispersed in the fuel oil. Of special interest is coal dust. These emulsions are achieved through a blend of cationic, nonionic, and anionic surfactants. Included among the surfactants are alkylesters of orthophosphoric acid.

U.S. Pat. No. 4,375,358 teaches slurry compositions of finely devided carbonaceous solids in water. The compositions include a gelling agent to provide a supporting gel and a viscosity builder to reduce the bleeding of the gel. In the absence of the viscosity builder, water separates and an undesirable phase is produced. Xanthan gum is disclosed as a supporting gel.

U.S. Pat. No. 4,355,651 discloses a method of transporting viscous hydrocarbons through pipes by adding water containing an effective amount of a phosphate ester of a specific block copolymer. The patent is directed toward crude oils, not heavy asphaltic materials.

Canadian Patent 1,142,114 discloses a method of inhibiting asphaltene precipitation from crude oil by adding phosphoric acid partial esters of higher alcohols. Alcohol substituents of less than nine or ten carbon atoms are taught to be ineffective tending to reduce the stability of asphaltenes in the crude oil.

U.S. Pat. No. 4,618,348 discloses a method for utilizing viscous hydrocarbons as fuels comprising forming an emulsion from a viscous hydrocarbon using a water soluble surfactant. The hydrocarbon is characterized as by having a viscosity of greater than 100 centipoise at 150° F.

SUMMARY OF THE INVENTION

A combustible heavy hydrocarbon-in-water emulsion comprising:

a. a nitrogen base neutralized phosphate-ester emulsifier in about 0.2 to about 1.0 wt. % amount;

b. a water-soluble emulsion stabilizer comprising a high molecular weight water-soluble thickener in about 0.02 to about 0.2 wt. % amount;

c. water in about 25 to 50 wt. % amount; and d. a high-softening point hydrocarbon material in an amount to make 100 wt. % emulsion wherein said hydrocarbon material is present in said emulsion in the form of substantially spherical particles having a median particle diameter in the range of 1 to 30 microns.

Also disclosed and claimed is a combustible slurry fuel made from said emulsion which contains carbonaceous solids, particularly petroleum coke. The process for making the emulsion and slurry fuel is also disclosed and claimed.

DETAILED DESCRIPTION OF THE INVENTION

Figure 1:
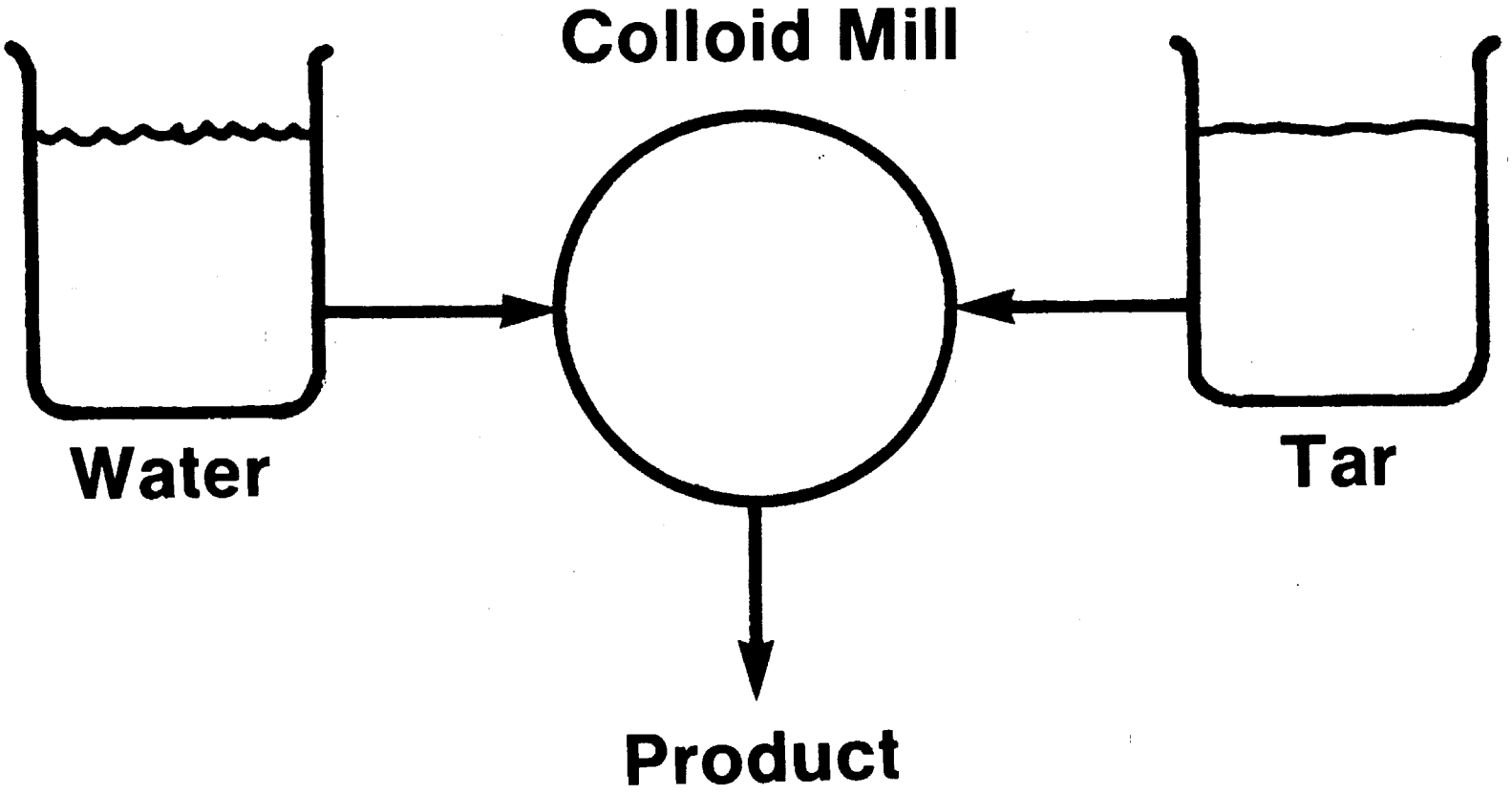
FIG. 1 is a flow diagram of a process for making the emulsion of the present invention.

The emulsion of the present invention contains a high-softening point heavy hydrocarbon material, preferably an asphaltic material; a nitrogen-base neutralized phosphate-ester emulsifying agent; a water-soluble emulsion stabilizer; and water. The particular types and amounts of each of these components is described hereafter as well as a process for making the emulsion. Also described are slurry fuels made from the emulsion and other solids, especially petroleum coke.

As used in the present invention the word "emulsion" refers to a stable mixture of two or more immiscible liquids held in suspension by a small amount of an emulsifier. One of the immiscible liquids in the present invention is water and the other is a heavy hydrocarbon which depending on temperature may be liquid, or solid. The heavy hydrocarbon is liquid at the elevated temperature at which the emulsion is formed. At ambient temperature the heavy hydrocarbon may be a liquid, very viscous liquid or a solid depending upon the softening point of the heavy hydrocarbon.

As used in the present invention the word "slurry" refers to a suspension of one or more solids in water.

As used in the present invention the word "additive" means the chemical in the emulsion excluding the hydrocarbon fuel and water.

As used in the present invention the term "heavy hydrocarbon" refers to a hydrocarbon having a softening point greater than 160° F. and preferably greater than 180°.

As used in the present invention the term "substantially spherical" means essentially spherical and is inclusive of spheroidal, oblate, or prolate.

Stability of the Emulsion and Other Emulsion Criteria

It is important that the produced hydrocarbon emulsions are stable for long periods of time, as they must be shipped and stored prior to burning. Unstable emulsions will separate producing a hard packing of heavy hydrocarbon having a high softening point which can plug lines, pumps and storage vessels.

Stability for heavy hydrocarbon fuel emulsions of at least six months are necessary, and longer stability, at least one year, are preferred. By stability it is meant that the emulsion, when stored at ambient temperature without mixing, does not separate; nor does it form more than a thin layer of soft packing or settling material which can easily be dispersed by simple mixing using low energy inputs.

It is an object of the present invention to produce emulsions and slurry fuels that are economical, stable and burn well. For this reason, all of the following criteria are important and preferably all of the following criteria are met by the compositions of the present invention:

1. The viscosity of the final emulsion and slurry fuels are less than 500 cSt, preferably less than 200 cSt at 77° F. This relatively low viscosity ensures that the emulsion and slurry fuels are pumpable without preheating, and can readily be atomized through a burner spray nozzle.
2. Solids loadings are high. Solid loadings are at least 60 wt. %, preferably at least 65 wt. %. High solids loadings result in high Btu fuels. High solids loadings minimize the need for water in the fuels.

Preferably the emulsifier is not the limiting factor in settling of the solids loading for the hydrocarbon emulsion. Some emulsifiers allow the formation of emulsions at low solids loadings, but are ineffective at higher solids loadings, such as at 60 wt. % or more solids. Preferably the emulsifiers of this invention can support maximum solid loadings, based on the particle size distribution and packing parameters, while maintaining acceptable emulsion viscosities, so that the emulsions can be pumped through a burner spray nozzle. The resulting emulsions have solid loadings that are maximized, based on the geometric packing limits of the hydrocarbon particles.

3. The emulsion fuel should have a static storage stability of at least 6 months at ambient temperature, as indicated by the absence of a hard pack at the bottom of the storage vessel. There is preferably no settling, or essentially no settling of the emulsion. Similarly the emulsified fuel should have a dynamic stability of at least 3 months. By dynamic stability it is meant the lack of particle settling when the fuel is subjected to the movement inherently occurring in truck, ship or rail transport.
4. The amount of additives is low. Preferably, the wt. % of emulsifier is less than 1%, and the wt. % of the stabilizer is less than 0.05 wt. %. Additionally, the stabilizer should provide storage stability with minimum viscosity increase.
5. The additives are essentially free of alkali metal. Any vanadium in the heavy hydrocarbon, particularly SDA tar, will combine with any added alkali metals, especially sodium and potassium, to produce low melting slag on burning. Slag formation and accumulation in furnaces causes severe loss in heat exchange and other burner-furnace operation problems. Typically, it is desirable to maintain the ratio of vanadium to alkali metals at greater than 6:1, preferably at greater than 10:1. The absence of alkali metals in the additives eliminates the need for analysis of the vanadium levels in the heavy hydrocarbon.
6. The heavy hydrocarbon in the emulsion consists of substantially spherical particles (or clusters of substantially spherical particles) having a median particle diameter in the range of 1 to 30 microns. Preferably the median particle size of the heavy hydrocarbon in the emulsion is in the range of 2 to 5 microns and more preferably 2–3 microns.

7. The additive system should be able to emulsify hydrocarbons with softening points of at least 170° F. and preferably 180° F. and above.

The High Softening Point Hydrocarbon Material

Heavy hydrocarbons, particularly asphaltic or bituminous materials useful in the present invention can be of varied character. See, for example, "Bituminous Materials: Asphalts, Tars, and Pitches" Vol. I, A. J. Hoiberg, Editor, 1964, Interscience, pages 25, the disclosure of which is incorporated herein by reference. Any petroleum residua (also known as fluxes) remaining after the separation of vaporizable hydrocarbons from oil fractions, or any relatively high molecular weight extracts obtained from petroleum refining or from naturally occurring hydrocarbons (including tar and uintaite) can be used.

Particularly preferred asphaltic materials include: petroleum distillation residua (vacuum distilled asphalt), a blend of hard petroleum distillation residue, a blend of uintaite and tar sands bottoms. Generally the bituminous material will have a viscosity at 350° F. of at least 50 cSt, and preferably in the range 100 to 10,000 cSt. Particularly preferred are bituminous materials (particularly vacuum distilled asphalt) having softening points in the range 160° F. to 400° F., preferably 180° to 250° F.

When emulsified the asphaltic materials will have median particle sizes in the range of 1 to 30 microns, preferably 2 to 5 microns and more preferably 2–3 microns in the emulsion.

Particularly preferred asphaltic materials for use in the present invention are asphaltic materials having softening points in the ranges described above and which contain from 10 to 40 weight percent asphaltenes, particularly asphalts obtained from solvent deasphalted bottoms, described below. Weight percent asphaltenes is measured by IP 143/84 using heptane (Institute of Petroleum, London, Standards for Petroleum and its Products published by John Wiley & Sons).

If the particular asphaltic material desired has too high of a softening point for emulsion blending purposes, the softening point can be pre-adjusted by the addition of lower boiling hydrocarbons such as cracked gas oil. Typically, the softening point will be adjusted to about 160°–180° F. Generally, it is desired to use as little cracked gas oil as possible because of its higher economic value. Generally it is preferred to use less than 15 weight percent cracked gas oil and more preferably less than 3 weight percent.

A particularly preferred asphaltic material for use in the present invention are asphalts obtained from solvent deasphalted bottoms. Solvent deasphalting or treating processes are well known in the art. See for example U.S. Pat. No. 3,392,104, the entire disclosure of which is incorporated herein by reference. The object in solvent treating is to remove asphaltenes and also to reduce the concentration of heteroorganic compounds of nitrogen, sulfur, oxygen, and metals contained in a residuum. In such processes the residuum is treated with a hydrocarbon solvent producing a fraction which is soluble in the solvent and a fraction which is not soluble in the solvent. The solvent soluble fraction is generally substantially a non-asphaltic residuum. The fraction which is not soluble in the solvent is the asphaltic portion of the residuum, and is known as solvent deasphalted ("SDA") bottoms or "SDA tar". SDA tar contains most of the asphaltenes, resins, and metal compounds. Typical solvents used in solvent deasphalting processes include light hydrocarbons such as propane and mixtures of propane and butane. The composition of solvent deasphalted bottoms is very complex and cannot be defined by structural formulas. However, solvent deasphalted bottoms can be characterized as having a hydrogen/carbon ratio of less than 1.25, a metals content greater than 500 ppm, a softening point greater than 140° F., a Ramsbottom Carbon greater than 20 wt. % as measured by ASTM D 524, and a viscosity in the range of 300–7000 cSt at 350° F. as measured by ASTM D 445. As used herein "metals" includes vanadium, nickel and iron. Varying viscosities of several SDA tars are shown by the data in Table I below.

TABLE I

SDA TAR VISCOSITIES (cSt) AT 275° F. AND 350° F. ASTM METHOD D 445

| Softening Point, °F. | Viscosity (cSt) at 275° F. | Viscosity (cSt) at 350° F. |
|---|---|---|
| 173 | 3,826 | 360 |
| 187 | 6,553 | 475 |
| 190 | 7,895 | 496 |
| 196 | 13,573 | 622 |
| 202 | 15,175 | 757 |
| 208 | 17,914 | 985 |
| 212 | 25,794 | 1,199 |
| 217 | 43,356 | 1,691 |
| 221 | 66,586 | 1,913 |

The Phosphate-Ester Emulsifying Agent

In order to obtain the stable emulsions of the present invention, it is necessary to use a phosphate ester emulsifying agent. Representative phosphate ester emulsifying agents include polyethylene glycol alkylphenyl phosphate esters having the formula:

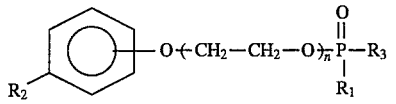

wherein $R_1$ is

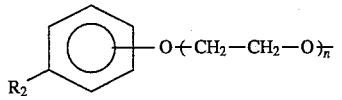

or hydrogen; $R_2$ is alkyl of $C_1$–$C_{30}$, preferably $C_5$–$C_{15}$, and most preferably $C_9$; and n is greater than 5, preferably 5–25, and most preferably 8–12; and $R_3$ is OH or the same as $R_1$. The molecular weight of the phosphate ester additive is also between 1000 and 3000, preferably 1500 to 2200.

Particularly preferred emulsifying agents are sold by Thompson-Hayward Chemical Company, and are known by the tradenames T-Mulz 565 (Chemical Abstracts Register No. 51811-79-1), 596, 598, and 734-2. Especially preferred is T-Mulz 565 which is believed to have a molecular weight of about 1825 and which is believed to be a polyethylene glycol nonylphenyl ether phosphate.

It is preferred to use an emulsifying agent which comprises a neutralized mixture of a mono- and a di-ester of ethoxylated alkylphenol and phosphoric acid.

Neutralization of the Emulsifying Agent

Neutralization of the emulsifying agent is accomplished by the addition of a nitrogen containing base to the emulsion. Such bases include ammonia and alkyl amines.

It is preferred that both the stabilizer and emulsifier have low total ash content to prevent slag formation in the furnace. Therefore, alkali metal hydroxides and other ash forming bases must be avoided in the neutralization. Sodium and potassium salts are particularly to be avoided because the interaction with vanadium found in the fuel is believed to favor low melting slag formation.

Preferably, neutralization is accomplished by adding ammonia or ammonium hydroxide to an aqueous solution of the phosphate esters. Most preferably, sufficient excess ammonium hydroxide is added so that the pH of the mixture is in excess of 9, preferably about 10 to 11.0.

The Water-Soluble Emulsion Stabilizer

In order to prevent separation of the emulsion into separate phases, a water-soluble emulsion stabilizer is required. Suitable emulsion stabilizers will generally comprise high molecular weight water soluble thickeners having molecular weights in the range 100,000 to 100,000,000 and preferable in the range 100,000 to 10,000,000.

The emulsion stabilizers should be stable to the high shear and high temperature conditions employed in preparing the emulsions and should also provide a sufficiently high viscosity at basic pH's (9 to 10) to thicken the water.

The water-soluble thickening agents used in the emulsion of this invention are well known. They are compounds which, upon dissolving in water at low concentrations, cause a dramatic increase in emulsion viscosity. Among the compounds having this property are the guar gums, high molecular weight polyethylene glycol, ethoxylated polyvinyl alcohol, hydroxy ethyl cellulose, ethoxylated cellulose, ethoxylated sorbitol, etc. Representative water-soluble cellulose ethers include sodium carboxymethyl cellulose, sodium carboxymethyl 2-hydroxyethyl cellulose, 2-hydroxyethyl cellulose, methyl cellulose, 2-hydroxypropyl methyl cellulose, 2-hydroxyethyl methyl cellulose, 2-hydroxybutyl methyl cellulose, 2-hydroxyethyl ethyl cellulose, 2-hydroxypropyl cellulose, etc.

Particularly preferred stabilizers are the water-soluble mucilaginous gums, such as xanthan gum, guar gum, and the like. Most preferably, the stabilizer is a xanthan gum.

Concentration of the Components

Generally the concentration of each component in the emulsion will be as shown below in Table II:

TABLE II

CONCENTRATION OF COMPONENTS IN EMULSION

| Component | Broad Range Wt. % | Preferred Range Wt. % |
|---|---|---|
| Heavy Hydrocarbon Material | 50–75 | 60–70 |
| Emulsifier | 0.2–2.0 | 0.4–1 |
| Stabilizer | 0.02–0.2 | 0.03–0.1 |
| Water | 25–50 | 30–40 |

Petroleum Coke and Other Optional Components

It is believed that the aforementioned emulsion which contains small substantially spherical particles of the high softening point asphaltic material facilities the blending of much larger sized solids. Such additional solids include ground petroleum coke particles having a median particle size in the range of 10 to 100 microns and preferably 20 to 50 microns, coal and other similarly sized carbonaceous solids. It is believed that the two different types and sizes of solids interact to make a suspension of much higher total solids concentration than would have been obtainable with just one type of solid. When such optional solids are added they may comprise 10 to 60, preferably 40 to 55 weight percent of the total weight percent. Preferably the coke particles are substantially greater in size than the hydrocarbon material. By "substantially greater" it it meant at least 5 to 20 times greater than the emulsified hydrocarbon particles.

By petroleum coke it is meant a solid carbonaceous residue produced by thermal decomposition of heavy petroleum fractions and/or cracked stocks.

When additional solid components are added to the emulsion, such as petroleum coke, a surfactant is necessary to provide added stability for the slurry fuel.

Representative surfactants include the polyether polyol nonionics.

Particularly preferred surfactants are sold by BASF and are known by the tradenames Pluradyne.

The preferred surfactant useful in preparing the SDA tar coke slurry fuel of this invention is a nonionic surfactant. A preferred nonionic surfactant is a block copolymer of ethylene oxide and a higher alkylene oxide. The preferred higher alkylene oxide is propylene oxide. More preferably, the initiator in preparing the ethylene oxide propylene oxide copolymer surfactant is an amine, preferably a diamine, such as ethylene diamine. The amine is first reacted with the hydrophobic alkaline oxide and then reacted with the ethylene oxide. The resulting block copolymer surfactant preferably has a free hydroxy terminus, but may be capped with, for example, an alkyl or ester group. Generally the concentration of each component in the preferred slurry fuels of the present invention will be as shown below in Table III:

TABLE III

CONCENTRATION OF COMPONENTS IN SLURRY FUEL

| Component | Broad Range Wt. % | Preferred Range Wt. % |
|---|---|---|
| Heavy Hydrocarbon | 20–40 | 25–30 |
| other solids (coke) | 30–60 | 40–55 |
| Emulsifier | 0.1–1.0 | 0.15–.25 |
| Stabilizer | 0.02–0.1 | 0.04–0.06 |
| Surfactant | 0.2–1 | 0.4–0.5 |
| Water | 15–50 | 25–35 |
| Total solids (coke + hydrocarbon) | 50–85 | 65–75 |

Slurry fuels can be made containing the above described emulsion and additional solids such that the total solids content in the stable slurry fuel is in the range 50 to 85, preferably 65 to 75. By total solids it is meant the weight percent hydrocarbons plus coke.

It has been surprisingly found that pulverized petroleum coke can be suspended in such an emulsion to produce a slurry containing 70 to 80% total solids by weight and having a viscosity less than 3000 cSt and preferably less than 1000 cSt at 77° F.

Minor amounts of other components and additives can be present. Such additives include anti-foaming agents, other surfactants, chelating agents and other bases. Small amounts of cracked gas oil, up to about 15 percent by weight, but preferably 2 to 3 percent, can be used to lower the softening point of the asphaltic material to the ranges mentioned previously.

Making the Emulsion

The combustible heavy hydrocarbon water emulsion of the present invention can be made by various methods. However, it is critical to the formation of the emulsion of the present invention that the heavy hydrocarbon material is maintained above its softening point during formation of the emulsion, i.e., during formation of the heavy hydrocarbon particles. Maintaining the heavy hydrocarbon material above its softening point is essential for the formation of regular and substantially spherically shaped particles of heavy hydrocarbon. Generally it is preferred to maintain the heavy hydrocarbon substantially above its softening point, generally at least 50° F. and more preferably 200° F. or more above its softening point to substantially reduce the viscosity during formation of the emulsion. While maintaining the heavy hydrocarbon above its softening point and using a mixing device such as a colloid mill, a liquid/liquid (water/liquid heavy hydrocarbon) emulsion is initially formed wherein the heavy hydrocarbon is in the form of substantially spherical particles having a median diameter in the range of 1 to 30 microns. After the liquid-liquid emulsification, the heavy hydrocarbon cools below its softening point while maintaining its regular spherical shape.

Colloid mills are preferred for use in making the emulsion although other methods and apparatus can be used. The colloid mill must be operated at an elevated temperature so that the heavy hydrocarbon is well above its softening point and at elevated pressure so that the water is maintained in the liquid phase during formation of the emulsion.

One preferred method for making the emulsion is shown in FIG. 1 and comprises the steps of:

a. preparing an emulsifier-water mixture containing the neutralized phosphate-ester and the water-soluble thickener additives and heating the mixture to a temperature of from 70° F. to 190° F., preferably 120° to 140° F.;

b. heating said high-softening point asphaltic material at a temperature in the range of about 250° F. to 500° F., preferably 350° F. to 400° F., to form a viscous asphaltic melt having a viscosity in the range 200 to 500 cSt;

c. emulsifying said viscous asphaltic melt in said emulsifier-water mixture in a single pass through a colloid mill operated at an elevated temperature of about 200° F. to 300° F. and elevated pressure of about 40 to 90 psig; and d. cooling said emulsion to a temperature substantially below 200° F. under an elevated pressure sufficient to avoid substantial water evaporation.

The product is cooled in conventional heat exchangers at sufficient back pressure to avoid water loss by evaporation.

One Preferred Embodiment of the Invention, SDA Tar, Emulsion

One preferred embodiment of the invention comprises a hydrocarbon-in-water slurry of SDA tar particles having a median particle size of 1 to 5 microns diameter that is fluid, and which is consequently referred to as an emulsion of SDA tar. It can be fed to a burner tip, and permits the efficient burning of SDA tar with subsequent recovery of the fuel values. Among other things, this preferred embodiment of the invention is based on our discovery that in order to make a stable emulsion of SDA tar, it is necessary to liquefy the tar and make it flowable by heating, if necessary to a temperature in the range of about 350° F. to 400° F., emulsify with water heated to a temperature in the range of 100° F. to 160° F. in a high shear emulsification mill, e.g., a colloid mill, operated at elevated temperatures, preferably in the range of 200° F. to 300° F., and at elevated pressures to prevent water evaporation in the presence of a phosphate ester emulsification agent and an emulsion stabilizer. The product is cooled in heat exchangers at sufficient back pressure to avoid water loss by evaporation. While a water mixing temperature of 100°–160° F. is specified, this is not critical.

Surprisingly, the SDA tar emulsion of the present invention does not burn to produce more $NO_x$ than crude oil containing one-half as much nitrogen as the SDA tar.

A typical emulsion of this preferred embodiment of the invention would have the following composition (all percents by weight, based on total product).

1. Xanthan gum, 0.02–0.2%, preferably 0.05%;
2. The mixed phosphate ester, 0.4–1.0%, preferably 0.5%;
3. Ammonium hydroxide in an amount sufficient to neutralize the mixture to a pH in the range of 10–11, 0.2–1.0%, preferably about 0.4%;
4. water, 25–50%, preferably about, 35%.
5. SDA tar, remaining amount.

It has been found that the SDA tar emulsion heretofore described comprises substantially spherical SDA tar particles having a median particle diameter of about 2–3 microns.

A Second Preferred Embodiment of the Invention SDA Tar-Coke Slurry

This SDA tar emulsion is found to be particularly suitable for forming a slurry with petroleum coke. The coke-in-water slurries can be produced using the SDA emulsion of the present invention which can be handled the same way that liquid fuel oil is handled. The stability of the coke-in-water slurry fuels is enhanced by the addition of emulsion. Moreover the fuel heat value of the emulsion is further increased by the high solid loadings that can be obtained in the slurry. To accomplish this, the petroleum coke is ground and screened to less than 100 mesh and a median particle diameter of about 35 microns. The ground petroleum coke is blended with an SDA tar emulsion heretofore described. It is believed that the blend of small particles of the SDA tar in the aforementioned emulsion with the much larger ground petroleum coke particles enables us to make a suspension of much higher total solids concentration. In fact, pulverized petroleum coke can be suspended in such emulsion to produce a slurry containing 70 to even 85% total solids by weight and having a viscosity in the range of about 500 to 3000 cSt at 77° F.

The combination of petroleum coke, a solid, with the SDA tar emulsion produces a fuel of surprisingly good burning characteristics.

Petroleum coke has a high heating value, however, the low volatile content makes it difficult to burn by itself. The higher volatile SDA tar combined with the low volatile coke makes an ideal fuel with a high heating value. Heating values can vary greatly, however, for the preferred SDA tar emulsions of the present invention heating values greater than about 17,000 Btu/pound are preferred. For the SDA tar/coke emulsions of the present invention heating values in the range 14,500 to 16,000 Btu/pound are preferred.

EXEMPLIFICATION

EXAMPLE 1

(Tar/Water Emulsion)

Product in Run 1 was produced in the lab as follows: 63.6 g of Kelzan stabilizer was added to 13.6 Kg of water and mixed for about 5 minutes with a high shear mixer. 7 g of formaldehyde was added to prevent bacterial degradation. 30.5 Kg of water was added to this concentrated Kelzan solution and mixed for about 10 minutes. 648 g of T-Mulz 565 was added to the same container and mixed for about 5 minutes. The Kelzan was added before T-Mulz 565 to minimize foaming. 516 g of ammonium hydroxide (28% $NH_3$ in water) was then added and everything was mixed for about 5 minutes. The above procedure was done at room temperature.

The SDA tar was heated to 375° F. prior to emulsification. The softening point was adjusted to about 180° F. using cracked gas oil. The colloid mill and the lines were heated to about 375° F.

Water was directed through the mill at 1.4 gpm initially and SDA tar was directed through the mill at 1.0 gpm initially. Gradually the water flow rate was reduced to 0.88 gpm and the SDA tar flow rate was increased to 1.63 gpm to produce a fuel with 65% solids content. About 90 psi pressure was maintained to prevent water vaporization until the fuel passed through the heat exchanger. The tar/water emulsion was collected and stored at room temperature.

A number of runs were made. The results of attempts to make various emulsions using varying additives and conditions are shown in Table IV. The emulsion was rated as pass or fail using the criterion set forth earlier in the specification under the heading "Stability of the Emulsion and other Emulsion Criteria". The amounts of each component and the results are also reported below in Table IV.

TABLE IV

| Run No. | Emulsifier | Emulsion Concentration Wt. % | Emulsion[11] Stabilizer | Stabilizer Concentration Wt. % | Softening Point of SDA Tar, °F. | Median[13] Particle Size, Micron | Solids Content, Wt. % | Pass/Fail |
|---|---|---|---|---|---|---|---|---|
| 1 | Phosphate ester[6] + $NH_4OH$ | 0.5 | Xanthan gum | .05 | 189 | 2.3 | 64.4 | Pass |
| 2 | Alkylbenzene sulfonate[1] | 2.0 | — | — | 196 | 3 | 60 Max. | Fail[8] |
| 3 | Fatty amine/fatty diamine[2] | 2.0 | — | — | 178 | — | — | Fail[10] |
| 4 | Lignosulfonate[3] | 2.0 | Xanthan gum | .05 | 158 | 36 | 61 Max. | Fail[8/9] |
| 5 | Polyether polyol[4] | 1.0 | Xanthan gum | .05 | 177 | 36 | 60 Max. | Fail[8] |
| 6 | Naphthenic acid[5] + $NH_4OH$ | 1.5 | Xanthan gum | .05 | 160 | 35 | 68 | Fail[9] |
| 7 | Petroleum sulfonate[7] | 0.5 | Xanthan gum | .05 | 180 | — | — | Fail[10] |
| 8 | Phosphate ester[6] + $NH_4OH$ | 0.5 | — | — | 180 | 3.9 | 64.3 | Fail[12] |
| 9 | Phosphate ester[6] + $NH_4OH$ | 0.5 | Xanthan gum | .05 | 180 | 2.1 | 65.2 | Pass |

[1]Witconate P1059
[2]Arosurf-AA-27 by Sherex Chemical Company, Inc.
[3]Orzan AE ($NH_4$+)
[4]Pluradyne
[5]Naphthenic acid
[6]T-Rulz 565
[7]Petronate L
[8]Additive limited solids loading
[9]Emulsion formed but unstable due to large particle size
[10]Did not form emulsion
[11]The xantham gum used was Kelzan
[12]Emulsion formed but did not have storage stability beyond a few days.
[13]Of SDA tar Comparing run 1 and 8 demonstrates that both the emulsifier and the emulsion stabilizer are required to form a stable emulsion. when xanthan gum was eliminated a hard layer of solids formed on the bottom of the emulsion in a few days. Run 6 shows the importance of particle size on producing stable fuel emulsions.

Most other emulsifiers (Run 2, 3, 4, 5, 6 and 7) were unacceptable even at levels up to four times that of the phosphate ester because they either failed to form an emulsion, had limited solids loading, or resulted in a fuel with unacceptable storage stability.

Figure 2:
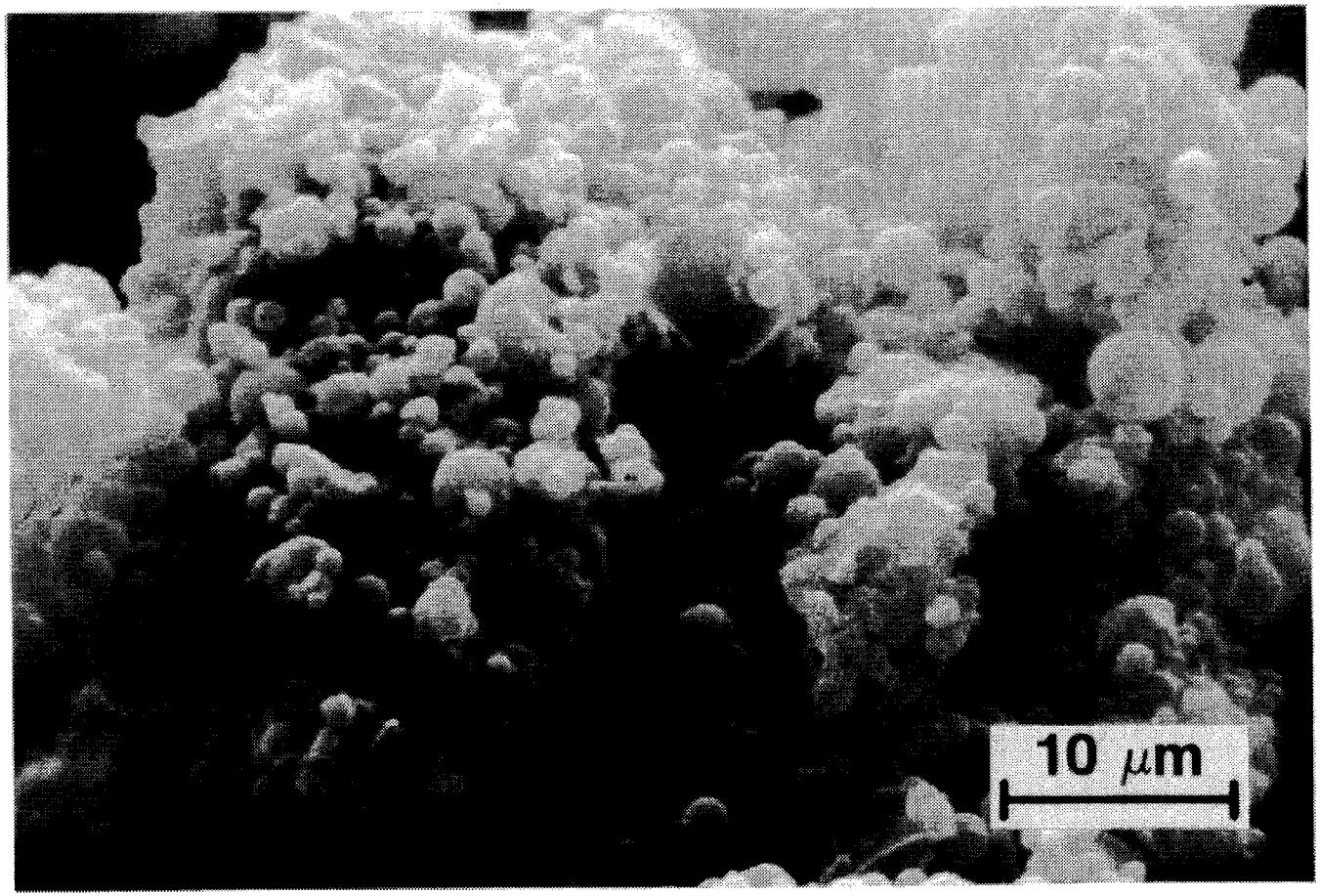
FIG. 2 is a photograph of a heavy hydrocarbon in water emulsion according to the present invention.

FIG. 2 is a view of the emulsion according to the present invention. The heavy hydrocarbon consisted of SDA tar and the emulsion was prepared as described earlier in example 1. As can be seen in the photograph the heavy hydrocarbon consists of substantially spherical particles (or clusters of substantially spherical particles) having a median particle diameter in the range of 1 to 30 microns.

Figure 3:
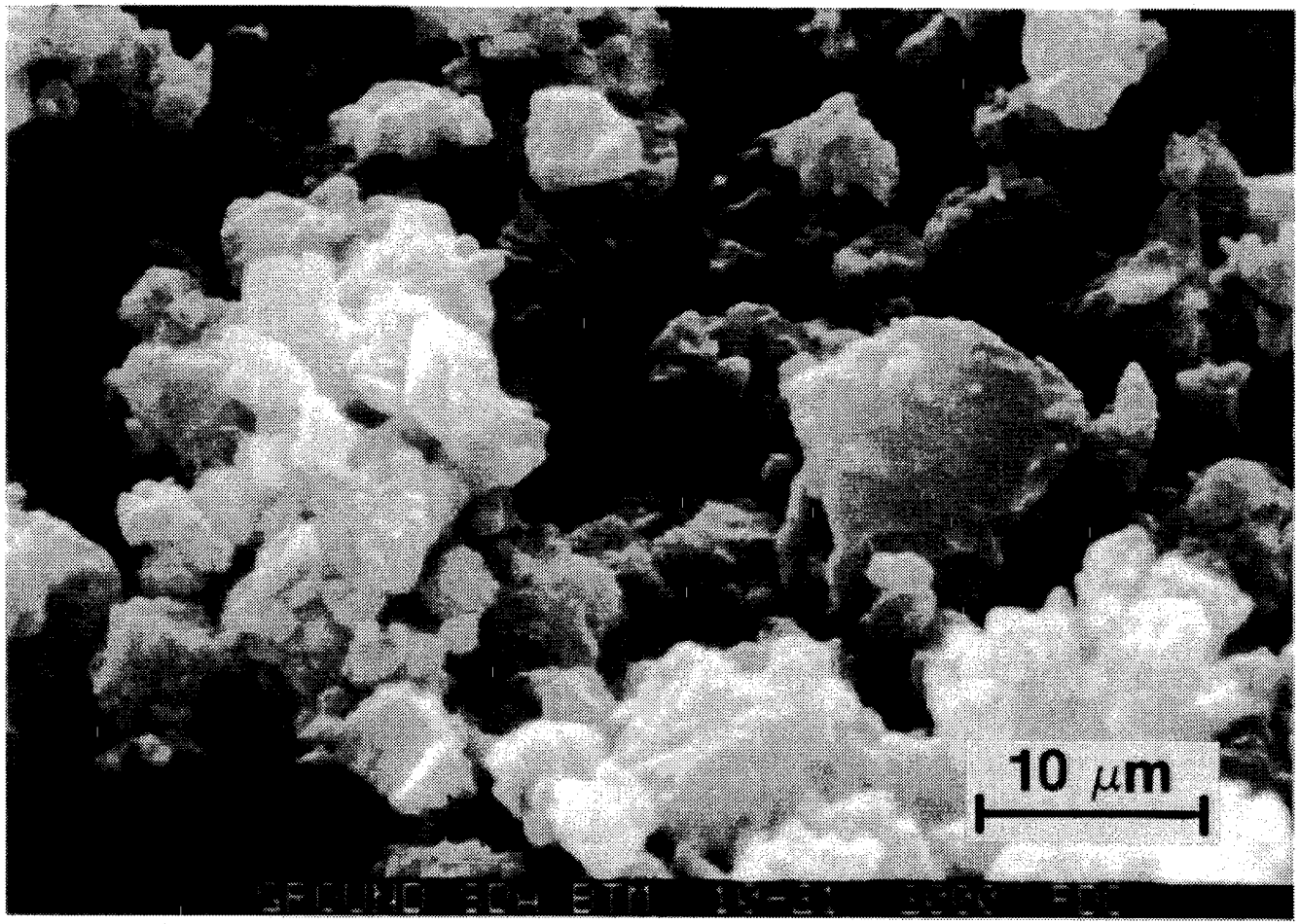
FIG. 3 is a photograph of a heavy hydrocarbon in water wherein the hydrocarbon particles have been produced by grinding as is known in the prior art.

FIG. 3 is a view of heavy hydrocarbons in water wherein the hydrocarbon particles have been produced by breaking/grinding below the softening point of the heavy hydrocarbon as taught in the prior art. The heavy hydrocarbon is the same heavy hydrocarbon as shown in FIG. 2. The particles have typical irregular shapes displaying the typical conchoidal fracture patterns characteristic of the breaking/grinding of a semi-solid glassy material below its softening point.

EXAMPLE 2

Exemplification of a Preferred Embodiment of the Invention Coke/Tar Slurry

A preferred procedure for making the coke/tar slurry of the present invention calls for coke, ground to less than 100 mesh (median particle size of 35 microns), to be blended with a suspension of SDA tar in water (emulsified median tar particle size of about 2–3 microns). A blend of the following composition was made.

| Component | Weight Percent |
|---|---|
| Coke | 49.6 |
| Tar | 24.8 |
| Water | 25.0 |
| Pluradyne | 0.40 |
| T-Mulz | 0.20 |
| Kelzan | 0.05 |

Pluradyne is a polyether polyol nonionic surfactant sold by BASF Wyandotte, Palatine, Illinois. T-Mulz is the aforementioned phosphate ester sold by Thompson Hayward Company, Kansas City, Kans. Kelzan is a xanthan gum sold by Kelco, Chicago, Ill.

This makes a 2:1 coke/SDA tar mixture with a total solids concentration of about 75%. It is believed that the ratio of particle sizes together with the 2:1 concentration ratio of particulate petroleum coke to SDA tar particles make for a high concentration slurry of relatively low viscosity. Laboratory tests on this blend showed this to be a stable slurry, easily prepared by mechanical agitation and confirm that the product is of relatively low viscosity.

However, attempts to make larger batches of material, ran into difficulties which were overcome by slowly blending the petroleum coke by hand into the emulsion until homogeneous and then mixing at high speed. However, if the coke was initially added to the SDA emulsion with high speed mixing, a product was produced which tended to have stability problems and sometimes created a rigid foam. In investigating this problem, it was found that the tendency to form a gel increased with increasing temperature of mixing, with increasing mucilaginous gum concentration, e.g., the Kelzan stabilizer, and with increasing total solids concentration. In particular, it was found that gelling of components of the slurry during its formation process at elevated temperature, was caused by stabilizer cross-linking in the presence of iron.

The components of the coke/tar slurry were normally mixed at 65° F. However, increasing the mixing temperature to 75° F. dropped the gelling temperature from 85° to 75° F. When the mixing temperature was raised to 80° F., the slurry would set up as a rigid solid while the components were being mixed together. We found that a chelating agent, such as sodium gluconate, reduces the amount of available iron and minimizes the gelling. For example, the addition of 0.1% sodium gluconate in the slurry raised the temperature at which it would first gel from 85° F. to 95° F.

The gelling problem can be minimized without the addition of chelating agents by reducing the amount of added mucilaginous gum stabilizer (preferably keep stabilizer content to less than 0.05 wt. % based on weight of coke slurry), by lowering the total solids concentration, and by keeping the preparation temperature below 65° F. Several batches of material were made using this procedure with concentrations of solids ranging from 64 to 72%. No gelling problems were encountered. Tests with each finished batch show that it could be stored and mixed at temperatures up to 100° F. without gel formation. If the slurry is formed by handmixing of coke particulate with emulsion, it is necessary to homogenize the slurry, for example, by the use of blenders or homogenizers to reduce the formation of agglomerates.

Using the above described preferred embodiment of the invention, it appears that current slurry fuel formulations provide an upper limit of about 70%, preferably about 68% solids which can be atomized in conventional nozzles without plugging.

EXAMPLE 3

Coke/Tar Slurry

A coke/tar slurry was made to the following formulation using the procedures of Example 1 except for changes as shown below

| Component | Wt. % |
|---|---|
| Coke | 45.00 |
| SDA Tar | 22.30 |
| Water | 31.97 |
| Pluradyne | 0.50 |
| T-Mulz | 0.17 |
| Kelzan | 0.02 |
| $NH_3$ | 0.04 |

340 lbs. of a coke/tar slurry was prepared in a 55-gal drum. An SDA tar emulsion was prepared in a manner similar to Example 1 to provide all of the tar, T-Mulz, $NH_3$ and Kelzan and a portion of the water shown in above formulation. Additional water (66.9 lbs.) and pluradyne additive (1.70 lbs.) were mixed together until all was dissolved. This water/additive mixture was added to the SDA tar emulsion (118.3 lbs.) in a mixing drum and stirred. Coke (153.0 lbs.) (pre-screened to 100 mesh) was then slowly added and mixed by hand with a large paddle until thoroughly wetted. During the entire mixing operation care was taken that slurry or component temperatures did not exceed 65° F. at any time; cooling procedures were employed when necessary. The batch was then stirred with a mechanical stirrer for 2 hours. The final product was checked for percent solids and then run through a Tekmar homogenizer one time.

Examples of the effect of various additives on the stability and viscosity of coke/SDA tar emulsions are also shown in Table V below.

TABLE V

EFFECT OF ADDITIVES ON STABILITY
All Blends Contain 50% Coke, 25% SDA Tar, and 25% Water and Additives

| Additives Added to Coke Tar Slurry, Wt %[1] | | | | | | | Stability[2] (Settling) Rating | |
|---|---|---|---|---|---|---|---|---|
| Run No. | Pluradyne | Kelzan | Daxad 32 | Armogard CMW 6000 | Synopen N | Whitconate P 10-59 | Six Weeks | 3 Pass/Fail |
| 1-A | — | — | — | — | — | — | XX | Fail |
| 1-B | — | — | — | — | — | — | XX | Fail |
| 1-D | .50 | — | — | — | — | — | B | Fail |
| 1-E | .40 | — | — | — | — | — | XX | Fail |
| 1-F | .20 | — | — | — | — | — | XX | Fail |
| 1-G | .10 | — | — | — | — | — | XX | Fail |
| 2-A | — | — | .50 | — | — | — | X | Fail |
| 2-B | — | — | — | .50 | — | — | XX | Fail |
| 2-C | — | — | — | — | .50 | — | XX | Fail |
| 2-D | — | — | — | — | — | .50 | XX | Fail |
| 2-F | .50 | — | — | — | — | — | D | Fail |
| 2-G | — | — | — | — | — | — | XX | Fail |
| 2-H | .50 | .030 | — | — | — | — | A | Pass |
| 2-I | .50 | .015 | — | — | — | — | A | Pass |
| 2-J | .35 | .030 | — | — | — | — | A | Pass |
| 2-K | .35 | .015 | — | — | — | — | B | Fail |
| 2-L | .35 | — | — | — | — | — | D | Fail |

[1]All blends contain 0.20% T-Mulz 565 and 0.02% Kelzan from the additives used in preparing the SDA tar emulsion in addition to the above.
[2]Rating System:
A = No evidence of settling.
B = ≤ ⅛ inch soft settling, very easy to remix.
C = ≤ ¼ inch soft settling, easy to remix.
D = > ¼ inch soft or semisoft settling, moderately easy to remix.
X = Hard settling difficult to remix.
XX = Hard settling: very difficult or impossible to remix.
3 Pass criteria determined by "A" rating at six weeks.

The data in Table V demonstrates that with an additional solid component such as coke a surfactant additive is necessary to obtain a stable slurry.

It should be observed that the exact composition of many tradenamed additives used in this application are not generally made public by the manufactures and their composition can be at best only approximated analytically by considerable effort. Nevertheless, the presence of certain functional groups can be established with relative certainty and to a degree sufficient to illustrate the effectiveness of the compositions of this invention relative to previously described compositions. In addition, these compositions and information regarding their use are of course available from the respective manufacturers.

As will be evident to those skilled in the art, various modifications of this invention can be made or followed, in light of the foregoing disclosure and discussion, without departing from the spirit or scope of the disclosure or from the scope of the following claims.

What is claimed is:

1. A combustible heavy hydrocarbon-in-water emulsion comprising:

a. a nitrogen base neutralized phosphate-ester emulsifier in about 0.2 to about 1.0 wt. % amount, b. a water-soluble emulsion stabilizer comprising a high molecular weight water-soluble thickener in about 0.02 to about 0.2 wt. % amount;

c. water in about 25 to 50 wt. % amount; and d. a high softening point hydrocarbon material in an amount to make 100 wt. % emulsion wherein said hydrocarbon material consists essentially of substantially spherical particles having a median diameter in the range of 1 to 30 microns.

2. The emulsion of claim 1 wherein said hydrocarbon material has a softening point in the range 100 to 400° F., said emulsifier is an ammonium hydroxide neutralized salt of a mixed mono- and di-ester of ethoxlylated alkylphenol and phosphoric acid, and said emulsion stabilizer is a mucilaginous gum.

3. The emulsion of claim 2 wherein said hydrocarbon is an asphaltic material.

4. The emulsion of claim 3 wherein said asphaltic material is SDA tar.

5. A slurry fuel comprising 30 to 60 weight percent particulate petroleum coke and the emulsion of claim 4.

6. A slurry fuel according to claim 5 comprising about 60–80 wt. % total solids.

7. A slurry fuel according to claim 6 wherein the coke to SDA tar ratio is about 1:1 to about 4:1.

8. A slurry fuel according to claim 7 wherein the coke to SDA tar ratio is about 1.5:1 to about 2.5:1.

9. The combustible water emulsion of claim 4 wherein the SDA tar is in the form of SDA tar particles substantially having a median particle diameter in the range of about 2–3 microns.

10. The slurry fuel of claim 5 wherein the coke particulate substantially comprises coke particles of median particle diameter substantially greater than 2–3 microns.

11. A combustible water emulsion of solvent deasphalted bottoms (SDA tar) comprising:

a. a water-soluble mucilaginous gum in about 0.02 to about 0.2 wt. % amount;

b. an ammonium salt of a mixed mono- and di-ester of ethoxylated alkylphenol and phosphoric acid in about 0.4 to about 1.0 wt. % amount;

c. excess ammonium hydroxide sufficient to form a pH in the range of 10–11 and in the amount of 0.2 to 1 wt. %;

d. water in about 25 to 50 wt. % amount; and e. SDA tar in an amount to make 100 wt. % emulsion wherein said hydrocarbon material consists essentially of substantially spherical particles having a median diameter in the range of 1 to 30 microns.

12. A slurry fuel comprising 40 to 55 weight percent particulate petroleum coke and the emulsion of claim 11.

13. A process of making a combustible water emulsion of a heavy hydrocarbon comprising the steps of:

a. heating said heavy hydrocarbon to a temperature above the softening point of said heavy hydrocarbon, and b. emulsifying said heavy hydrocarbon with water under conditions such that the heavy hydrocarbon is maintained above its softening point during emulsification and in the presence of a nitrogen base neutralized phosphate-ester emulsifying agent and a water-soluble emulsion stabilizer comprising a high molecular weight water-soluble thickener thereby forming an emulsion of said heavy hydrocarbon in water wherein said heavy hydrocarbon consists essentially of substantially spherical particles having a median particle diameter in the range of 1 to 30 microns, and wherein said phosphate-ester emulsifier is in the range 0.2 to about 2.0 weight percent, said water-soluble emulsion stabilizer is in the range about 0.02 to about 0.2 weight percent, water in about 25 to 50 weight percent and said heavy hydrocarbon in an amount to make 100 percent emulsion.

14. A process according to claim 13 wherein said heavy hydrocarbon is an SDA tar having a softening point in the range 180° to 230° F. and a colloid mill is used to emulsify said heavy hydrocarbon said colloid mill being operated at a temperature and pressure sufficient to maintain said heavy hydrocarbon in a fluid state during the formation of said emulsion.

15. A process of making a combustible water emulsion of solvent deasphalted bottoms (SDA tar) comprising the steps of:

a. melting said SDA tar by heating to a temperature in the range of about 350° F. to 400° F. to form an SDA tar melt, and b. emulsifying said SDA tar melt with water heated to a temperature in the range of about 100° F. to 160° F. in a colloid mill operated at elevated temperatures in the presence of a nitrogen base neutralized phosphate-ester emulsifying agent and a water-soluble emulsion stabilizer comprising a high molecular weight water-soluble thickener, and wherein said phosphate-ester emulsifier is in the range of 0.2 to about 2.0 weight percent, said water-soluble emulsion stabilizer is in the range about 0.02 to about 0.2 weight percent, water in about 25 to 50 weight percent and said solvent deasphalted bottoms in an amount to make 100 percent emulsion and said solvent deasphalted bottoms consists essentially of substantially spherical particles having a median diameter in the range of 1 to 30 microns.

16. A process according to claim 15 wherein said emulsifying agent comprises an ammonium salt of a mixed mono- and di-ester of ethoxylated alkylphenol and phosphoric acid neutralized with excess ammonium hydroxide, and said emulsion stabilizer comprises a mucilaginous gum.

17. A process for making a combustible water emulsion of a high-softening point asphaltic material comprising the steps of:

a. preparing an emulsifier-water mixture containing a neutralized phosphate-ester and water-soluble thickener and heating the mixture to a temperature of from 70° F. to 190° F.;

b. heating a high-softening point asphaltic material at a temperature in the range of about 250° F. to 500° F. to form a viscous asphaltic melt having a viscosity in the range 200 to 500 cSt;

c. emulsifying said viscous asphaltic melt in said emulsifier-water mixture in a single pass through a colloid mill operated at an elevated temperature of about 200° F. to 300° F. and elevated pressure of about 40 to 90 psig; and d. cooling said emulsion to a temperature substantially below 200° F. under an elevated pressure sufficient to avoid substantial water evaporation, and wherein said phosphate-ester emulsifier is in the range 0.2 to about 2.0 weight percent, said water-soluble thickener stabilizer in about 0.02 to about 0.2 weight percent, water in about 25 to 50 weight percent and said high-softening point asphaltic material in an amount to make 100 percent emulsion and said high-softening point asphaltic material consists essentially of substantially spherical particles having a median diameter in the range of 1 to 31 microns.

18. A hydrocarbon-in-water emulsion comprising 50 to 75 weight percent hydrocarbon and 25 to 50 percent water wherein said hydrocarbon is an SDA tar having as a softening point greater than 160° F. and said hydrocarbon is present in said emulsion as substantially spherical particles with a median diameter in the range of 1 to 30 microns.

19. The emulsion of claim 18 wherein said hydrocarbon is an SDA tar having a softening point in the range 180° to 230° F. and wherein the median particle size of said hydrocarbon is in the range of 2 to 5 microns.

* * * * *